US008056276B2

(12) United States Patent
Hu

(10) Patent No.: US 8,056,276 B2
(45) Date of Patent: Nov. 15, 2011

(54) BACKLASH VIBRATION STRUCTURE FOR TOY RIFLE

(76) Inventor: Shih-Che Hu, Yung Kang (TW)

( * ) Notice: Subject to any disclaimer, the term of this patent is extended or adjusted under 35 U.S.C. 154(b) by 554 days.

(21) Appl. No.: 11/986,597

(22) Filed: Nov. 23, 2007

(65) Prior Publication Data

US 2009/0101130 A1 Apr. 23, 2009

(30) Foreign Application Priority Data

Oct. 22, 2007 (TW) ..... 96139495 A

(51) Int. Cl.
*F41A 33/06* (2006.01)
*F41B 11/00* (2006.01)

(52) U.S. Cl. ..... 42/54; 124/65; 124/66

(58) Field of Classification Search ..... 124/65–68, 124/80; 267/167; 42/54, 55, 57, 58, 1.06
See application file for complete search history.

(56) References Cited

U.S. PATENT DOCUMENTS

| | | | | |
|---|---|---|---|---|
| 2,924,211 | A * | 2/1960 | McSwain | 124/61 |
| 5,261,384 | A * | 11/1993 | Hu | 124/66 |
| 6,371,099 | B1 * | 4/2002 | Lee | 124/66 |
| 6,553,707 | B1 * | 4/2003 | Tseng | 42/72 |
| 7,694,448 | B2 * | 4/2010 | Iwasawa | 42/54 |
| 2009/0127758 | A1 * | 5/2009 | Hu | 267/167 |

* cited by examiner

*Primary Examiner* — Gene Kim
*Assistant Examiner* — Scott Young
(74) *Attorney, Agent, or Firm* — Raymond Y. Chan; David and Raymond Patent Firm

(57) ABSTRACT

A backlash vibration structure for toy rifle (air soft rifle, BB-rifle) formed of a receiver extension, a weight, a reaction spring and a buttcap spacer is disclosed. The weight has a front extension inserted through the lower receiver of the toy riffle and connected to the rear end of the piston spring at the rear side of the piston so that the component parts of the backlash vibration structure doe not touch the piston during movement of the piston. An adjustment knob is provided at the buttcap spacer for adjustment of the reaction spring to adjust the level of the backlash vibration.

8 Claims, 7 Drawing Sheets

BACKLASH VIBRATION STRUCTURE FOR TOY RIFLE

BACKGROUND OF THE INVENTION

1. Field of the Invention

The present invention relates to a toy rifle (air soft rifle/BB-rifle) and more particularly, to a backlash vibration structure for toy rifle that improves the connection relationship between the piston and the weight.

2. Description of the Related Art

To simulation of a real automatic rifle, a toy rifle (air soft rifle/BB-rifle) may be provided with a backlash vibration structure. Taiwan Patent Publication No. 200708712 discloses a similar design. However, this design is still not satisfactory in function.

FIG. 1 illustrates a backlash vibration structure a' installed in a toy riffle. As illustrated, the backlash vibration structure a' is arranged at the rear side in axial alignment with the piston 10 in the piston-cylinder mechanism b', comprising a receiver extension 20, a weight 30, a reaction spring 40, and a buttcap spacer 50. The receiver extension 20 is connected to the rear side of the lower receiver c' that accommodates the piston-cylinder mechanism b'. The weight 30 and the reaction spring 40 are mounted inside the receiver extension 20. The reaction spring 40 is connected between the weight 30 and the buttcap spacer 50. The piston 10 has its rear side mounted with a piston spring 101. The piston spring 101 has its one end received in the piston 10, and its other end stopped against an inside wall of the lower receiver c'. Further, a connection rod 60 is movably inserted through the lower receiver c' and connected between the piston spring 101 and the weight 30. The toy riffle further comprises a transmission mechanism d', a trigger e' and a bullet pusher f'. When pressed the trigger e', the transmission mechanism d' is forced to move the piston-cylinder mechanism b', causing the bullet pusher f' to push the bullet into the firing position for striking by (the firing pin of) the piston 10. During movement of the transmission mechanism d', the piston 10 is moved backwards, and the connection rod 60 is moved with the piston 10 to force the weight 30 against the reaction spring 40 (see FIG. 2). When over the compression limit of the reaction spring 40, the reaction spring 40 forces the weight 30 forwards, and the piston 10 is moved forwards in a rush to shoot the bullet (see also FIG. 1). During forward movement of the weight 30, a reactive force is produced, causing a backlash vibration.

According to the aforesaid design, the connection rod 60 is connected between the piston spring 101 and the weight 30 and has its front end suspending in the piston 10, the inside wall of the piston 10 will strike the front end of the connection rod 60 during backward movement of the piston 10, and the front end of the connection rod 60 will strike the inside wall of the piston 10 during forward movement of the weight 30. Therefore, the piston 10 wears quickly with use. Further, the pressure of the backlash is determined subject to the weight of the weight 30 and the spring force of the reaction spring 40 and the piston spring 101. However, because the weight of the weight 30 is fixed, and the spring force of the reaction spring 40 and the piston spring 101 will be gradually reducing after a long use. In consequence, the backlash vibration will become small and not adjustable after a long use of the toy riffle. Therefore, an improvement in this regard is necessary.

SUMMARY OF THE INVENTION

The present invention has been accomplished under the circumstances in view. It is the main object of the present invention to provide a toy rifle (air soft rifle/BB-rifle) backlash vibration structure that greatly prolongs the working life of the piston. It is another object of the present invention to provide a toy riffle backlash vibration structure that allows adjustment of the level of the backlash vibration.

To achieve these and other objects and according to one aspect of the present invention, the backlash vibration structure installed in a rear side of a lower receiver of a toy riffle in axial alignment with a piston in a piston-cylinder mechanism, comprising a receiver extension affixed to the rear side of the lower receiver, a weight mounted in and movable along the receiver extension relative to the lower receiver, a buttcap spacer detachably fastened to a rear side of the receiver extension, and a reaction spring connected between the weight and the buttcap spacer. The weight comprises a base mounted in and movable along the receiver extension and stopped against the front end of the reaction spring, a front tip suspending in the lower receiver and connected to the rear end of the piston spring, and a front extension inserted through the lower receiver and connected between the base and the front tip.

According to another aspect of the present invention, the buttcap spacer is detachably fastened to the rear side of the receiver extension for easy maintenance of the component parts of the backlash vibration structure.

According to still another aspect of the present invention, the backlash vibration structure further comprises an adjustment knob mounted in the buttcap spacer and stopped against a rear end of the reaction spring opposite to the weight and rotatable relative to the buttcap spacer to adjust the spring force of the reaction spring.

According to still another aspect of the present invention, the backlash vibration structure further comprises a stop plate fixedly fastened to the adjustment knob and stopped against the rear end of the reaction spring.

DETAILED DESCRIPTION OF THE PREFERRED EMBODIMENT

Figure 1:
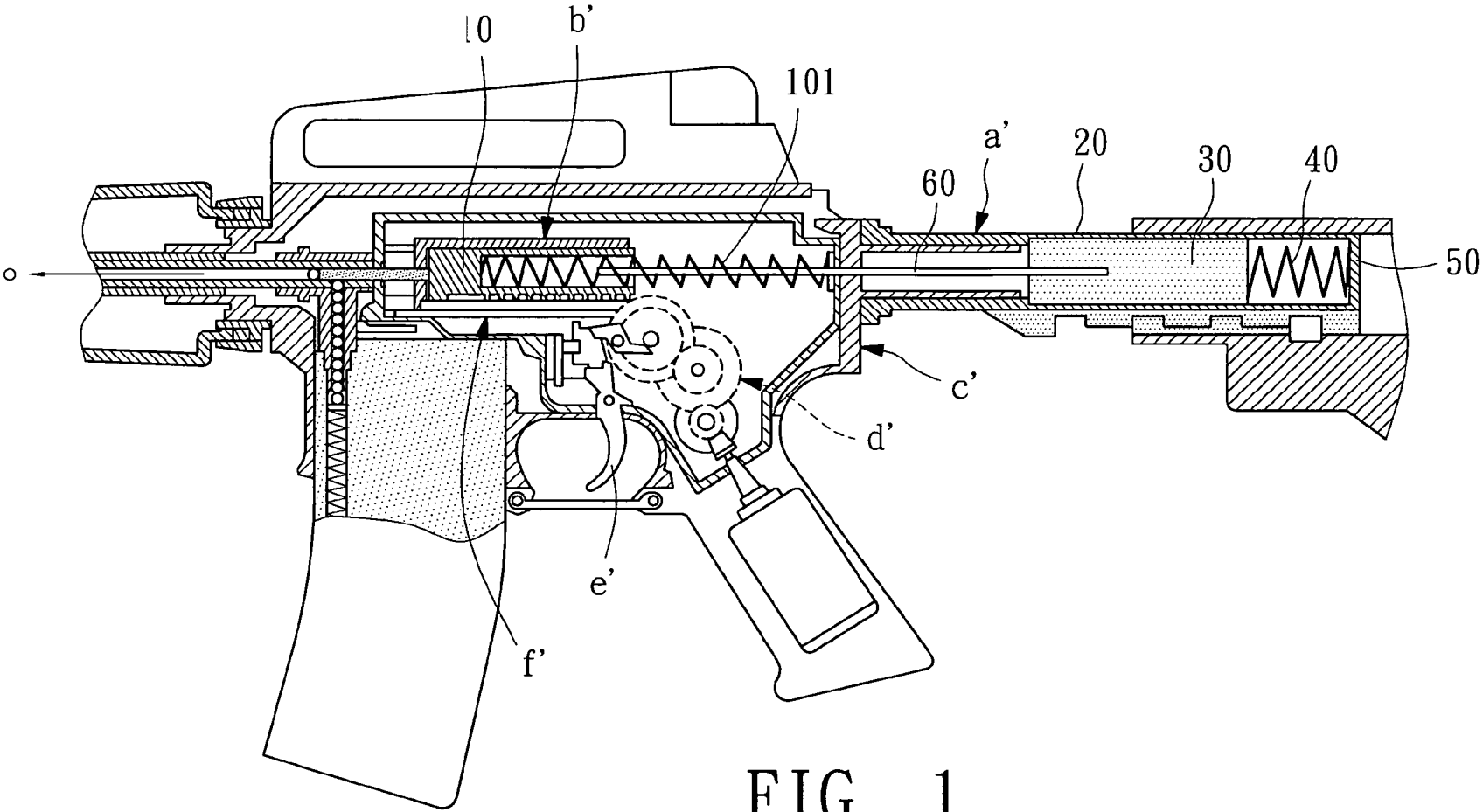
FIG. 1 (Prior Art)
FIG. 1 is a schematic drawing of a part of a toy rifle (air soft rifle/BB-rifle) according to the prior art, showing the arrangement of the backlash vibration structure and firing of a bullet.
Figure 2:
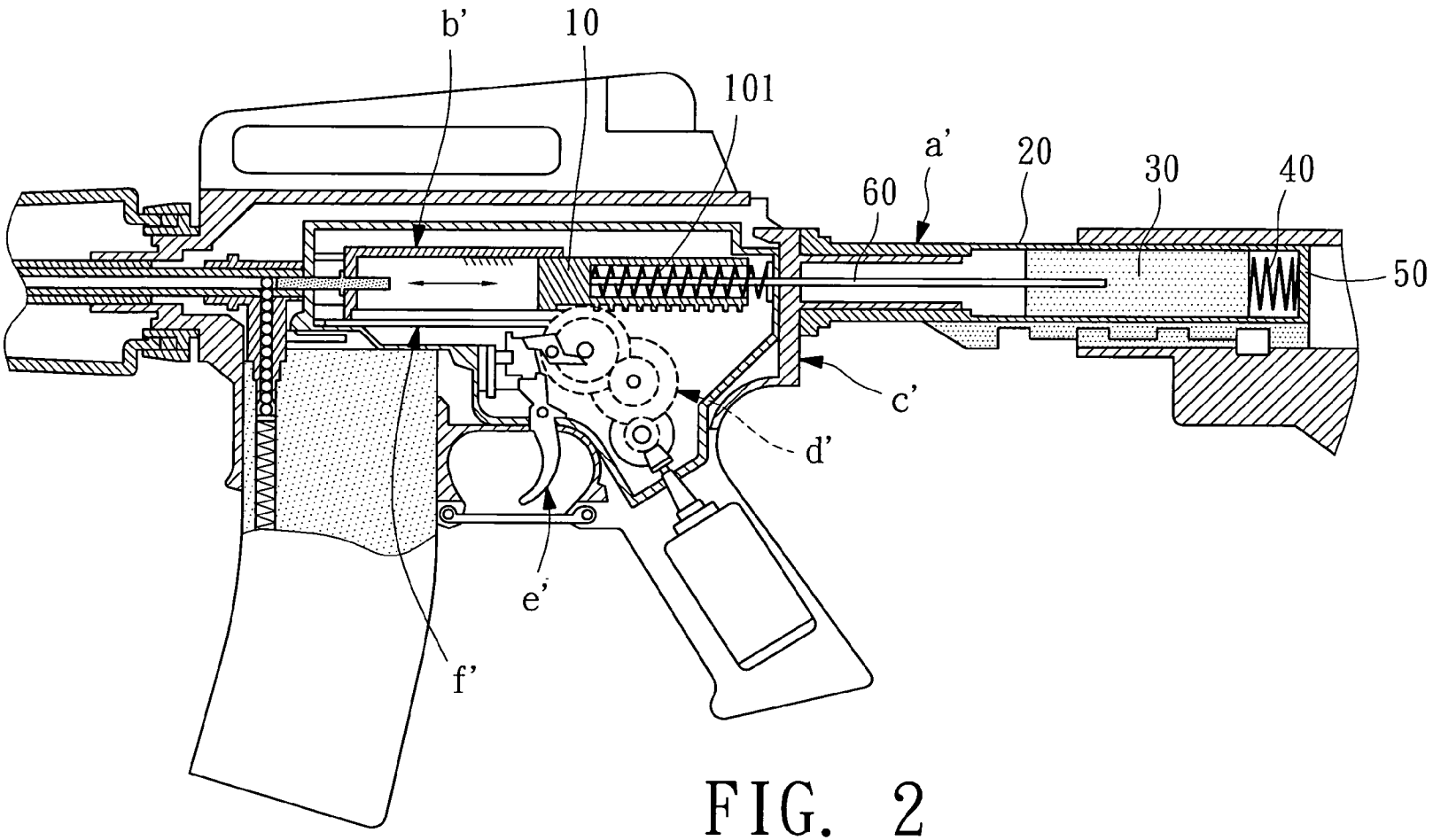
FIG. 2 (Prior Art)
FIG. 2 corresponds to FIG. 1, showing the piston moved backwards and the reaction spring compressed.
Figure 3:
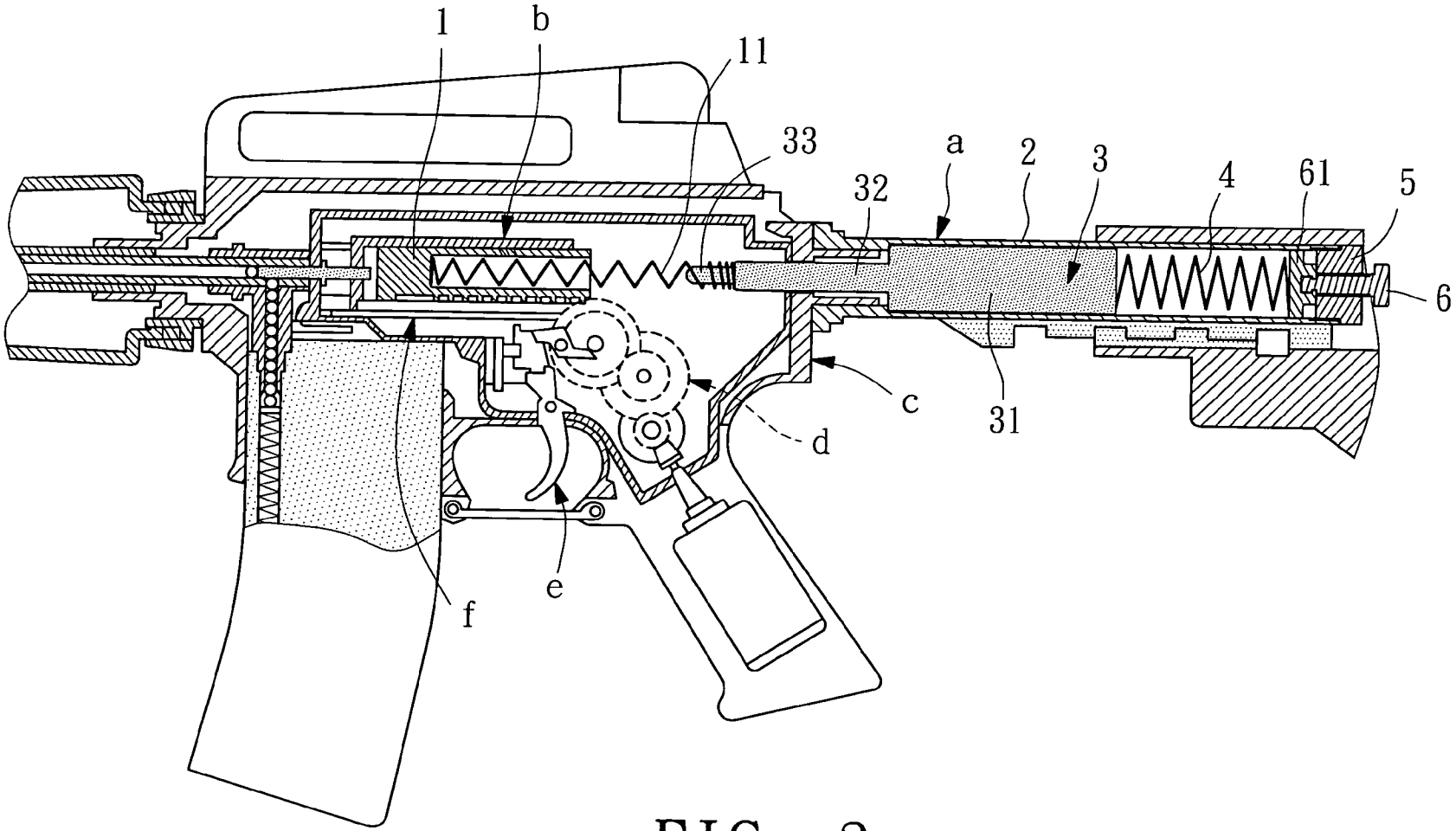
FIG. 3 is a schematic drawing showing a backlash vibration structure arranged in a toy rifle (air soft rifle/BB-rifle) according to the present invention.

Referring to FIG. 3, a backlash vibration structure a is arranged at the rear side in axial alignment with a piston 1 in a piston-cylinder mechanism b of a toy riffle. The piston 1 has a piston spring 11 mounted in its rear side. The piston spring 11 has its one end received in the rear side of the piston 1 and connected thereto. The toy riffle further comprises a transmission mechanism d, a trigger e and a bullet pusher f arranged in a lower receiver c under the piston-cylinder mechanism b. When pressed the trigger e, the transmission mechanism d is forced to move the piston-cylinder mechanism b, causing the bullet pusher f to push the bullet into the firing position for striking by (the firing pin of) the piston 1.

Figure 6:
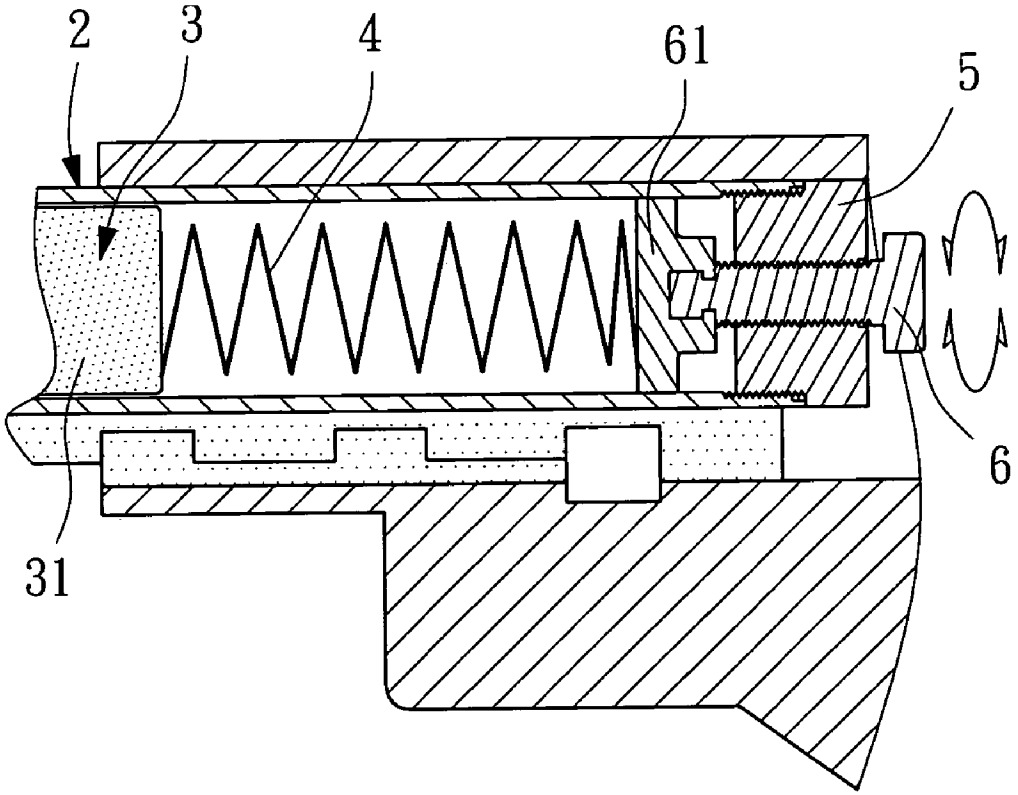
FIG. 6 is a schematic drawing of the backlash vibration structure according to the present invention, showing adjustment of the adjustment knob.
Figure 7:
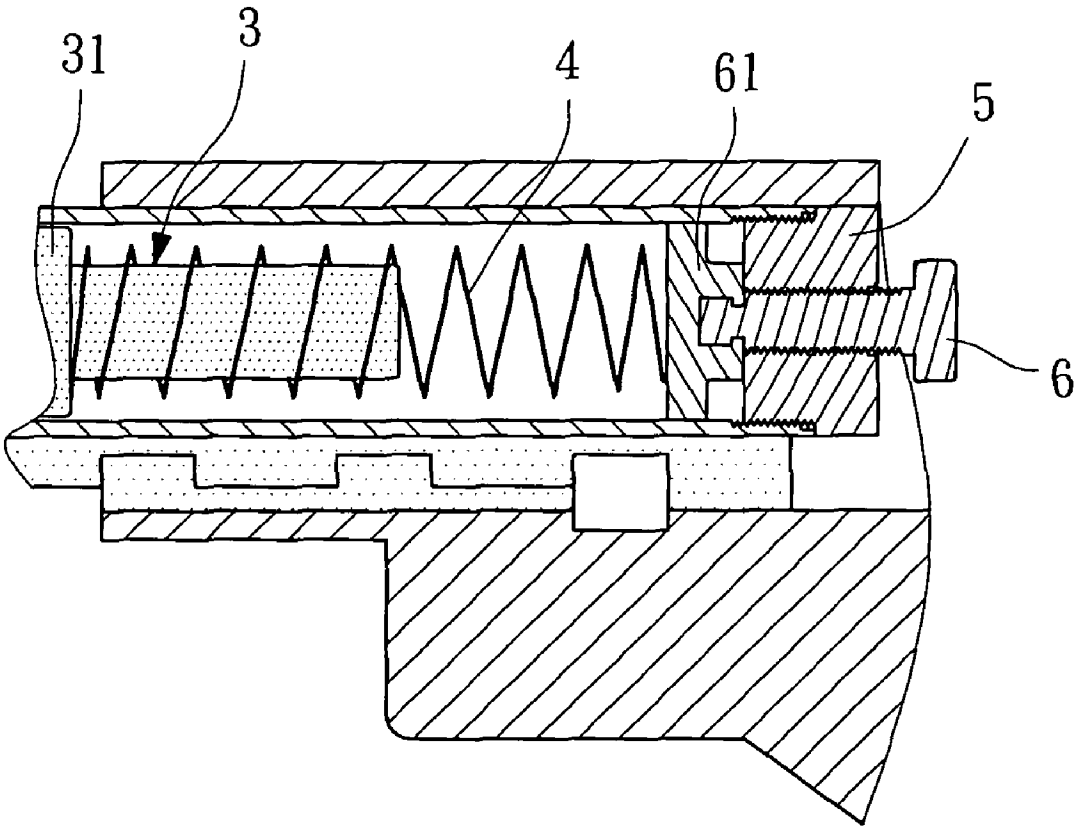
FIG. 7 is a schematic drawing of an alternate form of the mounting arrangement between the reaction spring and the weight of the backlash vibration structure according to the present invention.

The backlash vibration structure a comprises a receiver extension 2, a weight 3, a reaction spring 4, and a buttcap spacer 5. The receiver extension 2 is connected to the rear side of the lower receiver c that accommodates the piston-cylinder mechanism b. The weight 3 and the reaction spring 4 are mounted inside the receiver extension 2. The reaction spring 4 is connected between the weight 3 and the buttcap spacer 5. The weight 3 comprises a cylindrical base 31, a front tip 33, and a front extension 32 axially connected between the cylindrical base 31 and the front tip 33. The cylindrical base 31 is received in the receiver extension 2. The front extension 32 is inserted through (a hole on) the lower receiver c. The front tip 33 is fastened to one end of the piston spring 11 opposite to the piston 1. The buttcap spacer 5 is detachably fastened to the rear side of the receiver extension 2 (by, for example, a screw joint, as shown in FIGS. 6 and 7). An adjustment knob 6 is fastened to the buttcap spacer 5 and rotatable to adjust the spring force of the reaction spring 4. The adjustment knob 6 has its front side fixedly mounted with a stop plate 61 that is stopped against the rear end of the reaction spring 4. The reaction spring 4 has its front end fastened to the rear side of the cylindrical base 31 of the weight 3 and its rear end stopped against the stop plate 61 at the adjustment knob 6. FIGS. 6 and 7 show two different connection arrangements between the weight 3 and the reaction spring 4.

Figure 4:
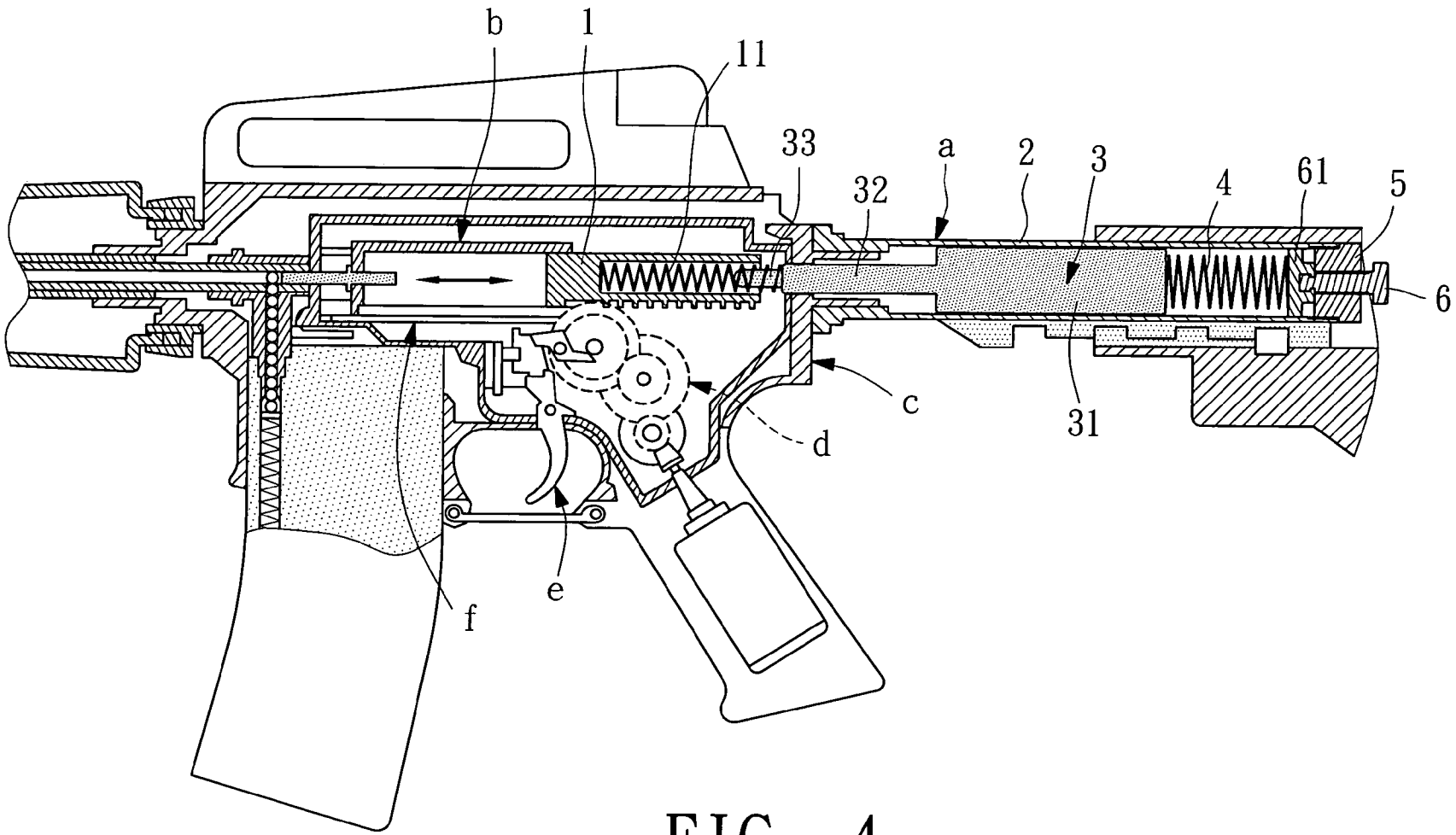
FIG. 4 corresponds to FIG. 3, showing the piston moved backwards and the reaction spring compressed.
Figure 5:
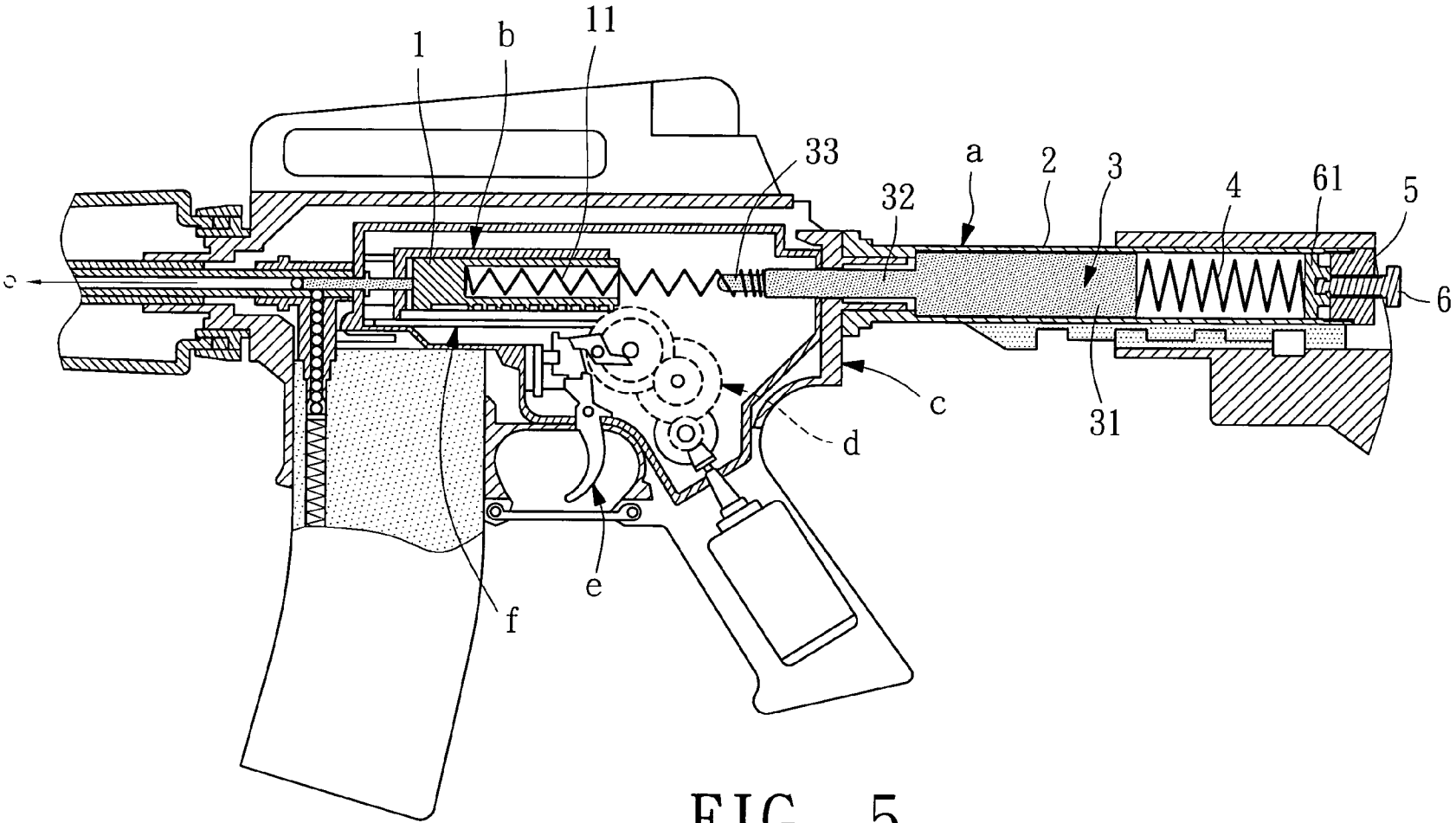
FIG. 5 corresponds to FIG. 4, showing the piston moved forwards and one bullet fired.

When pressed the trigger e, the transmission mechanism d is forced to move the piston 1 backwards (see FIG. 4). At this time, the weight 3 is forced backwards to compress the reaction spring 4. When over the compression limit, the reaction spring 4 forces the weight 3 forwards, and the piston 1 is forced forwards by the piston spring 11 to strike the bullet, causing shooting of the bullet (see FIG. 5). During forward movement of the weight 3, a backlash vibration is produced, simulating a backlash vibration of a real rifle during firing of a bullet. Further, the user can rotate the adjustment knob 6 to adjust the spring force of the reaction spring 4, thereby adjusting the level of the backlash vibration. When wishing to increase the level of the backlash vibration, rotate the adjustment knob 6 forwards relative to the buttcap spacer 5 to increase the spring force of the reaction spring 4. On the contrary, when wishing to reduce the level of the backlash vibration, rotate the adjustment knob 6 backwards relative to the buttcap spacer 5 to reduce the spring force of the reaction spring 4. Further, the buttcap spacer 5 can be removed from the receiver extension 2 for replacement of the internal component parts of the backlash vibration structure a.

As stated above, the invention provides a backlash vibration structure for toy riffle that has the following advantages and features:

1. Because the front end of the weight 3 is directly stopped against the rear end of the piston spring 11, the piston 1 will never rub against any component parts of the backlash vibration structure a during its movement. Therefore, the piston 1 does not wear easily and is durable in use. Further, the weight 3 can be made relatively bigger than the prior art design, increasing the backlash vibration.

2. By means of the adjustment knob 6, the user can adjust the level of the backlash vibration as desired.

3. The buttcap spacer 5 is detachable from the receiver extension 2 for easy maintenance and replacement of the component parts of the backlash vibration structure a.

Although a particular embodiment of the invention has been described in detail for purposes of illustration, various modifications and enhancements may be made without departing from the spirit and scope of the invention.

What the invention claimed is:

1. A backlash vibration structure for a toy gun having a trigger and a transmission mechanism for firing a toy riffle which is received in a rear side of a lower receiver in axial alignment with a piston in a piston-cylinder mechanism having a piston spring, wherein said backlash vibration structure comprises:

a receiver extension adapted for being connected to said rear side of said lower receiver;

a reaction spring received in said receiver extension;

a buttcap spacer coupled at a rear side of said receiver extension;

a weight disposed at said receiver extension at a position that said reaction spring is positioned between said weight and said buttcap spacer, wherein said weight has a front tip extended to said lower receiver for coupling with a rear end of said piston spring, wherein during an operation of said toy gun, said weight is forced backward to compress said reaction spring, wherein when over a compression limit of said reaction spring, said reaction spring forces said weight forwards to produce a backlash vibration; and an adjustable knob operatively coupled with said buttcap spacer and arranged to adjust a spring force of said reaction spring so as to selectively adjust a level of said backlash vibration, wherein when said adjustable knob is moved forward relative to said buttcap spacer, said spring force of said reaction spring is increased for increasing the level of said backlash vibration, when said adjustable knob is moved backward relative to said buttcap spacer, said spring force of said reaction spring is decreased for reducing the level of said backlash vibration.

2. The backlash vibration structure, as recited in claim 1, wherein said weight comprises a cylindrical base received in said receiver extension and movable along said receiver extension relative to said lower receiver, and a front extension axially extended from said cylindrical base to said front tip and extended to said lower receiver.

3. The backlash vibration structure, as recited in claim 2, further comprising a stop plate movably coupled in said receiver extension at a position that a front side of said stop plate is coupled at said reaction spring, wherein said adjustable knob is operatively coupled with said stop plate and is arranged in such a manner that when said adjustable knob is rotated to move said stop plate forward, said spring force of said reaction spring is increased for increasing the level of said backlash vibration, when said adjustable knob is rotated to move said stop plate backward, said spring force of said reaction spring is decreased for reducing the level of said backlash vibration.

4. The backlash vibration structure, as recited in claim 3, wherein said reaction spring has a front end fastened to a rear side of said cylindrical base of said weight and a rear end stopped against said stop plate.

5. The backlash vibration structure, as recited in claim 4, wherein said buttcap spacer is detachably coupled with said receiver extension for enabling said reaction spring being replaced when said buttcap spacer is detached from said receiver extension.

6. The backlash vibration structure, as recited in claim 2, wherein said buttcap spacer is detachably coupled with said receiver extension for enabling said reaction spring being replaced when said buttcap spacer is detached from said receiver extension.

7. The backlash vibration structure, as recited in claim 1, further comprising a stop plate movably coupled in said receiver extension at a position that a front side of said stop plate is coupled at said reaction spring, wherein said adjustable knob is operatively coupled with said stop plate and is arranged in such a manner that when said adjustable knob is rotated to move said stop plate forward, said spring force of said reaction spring is increased for increasing the level of said backlash vibration, when said adjustable knob is rotated to move said stop plate backward, said spring force of said reaction spring is decreased for reducing the level of said backlash vibration.

8. The backlash vibration structure, as recited in claim 1, wherein said buttcap spacer is detachably coupled with said receiver extension for enabling said reaction spring being replaced when said buttcap spacer is detached from said receiver extension.

* * * * *